US009081358B2

(12) United States Patent
Maeda et al.

(10) Patent No.: US 9,081,358 B2
(45) Date of Patent: Jul. 14, 2015

(54) FIXING APPARATUS, AND IMAGE FORMING APPARATUS EQUIPPED WITH FIXING APPARATUS

(71) Applicant: CANON KABUSHIKI KAISHA, Tokyo (JP)

(72) Inventors: Naoyuki Maeda, Mishima (JP); Ken Murooka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/254,106

(22) Filed: Apr. 16, 2014

(65) Prior Publication Data

US 2014/0314438 A1 Oct. 23, 2014

(30) Foreign Application Priority Data

Apr. 18, 2013 (JP) ..... 2013-087523
Mar. 26, 2014 (JP) ..... 2014-063767

(51) Int. Cl.
*G03G 21/20* (2006.01)
*G03G 21/16* (2006.01)
*G03G 15/20* (2006.01)

(52) U.S. Cl.
CPC ..... *G03G 21/1685* (2013.01); *G03G 15/2017* (2013.01); *G03G 2215/2035* (2013.01)

(58) Field of Classification Search
USPC ..... 399/92, 122, 411
See application file for complete search history.

(56) References Cited

U.S. PATENT DOCUMENTS

| | | | | |
|---|---|---|---|---|
| 5,539,509 | A * | 7/1996 | Tomoe et al. | 399/159 |
| 7,269,379 | B2 * | 9/2007 | Nakanishi | 399/122 |
| 7,953,348 | B2 * | 5/2011 | Chang et al. | 399/122 |
| 8,270,874 | B2 * | 9/2012 | Iwase et al. | 399/122 |
| 2013/0078016 | A1 * | 3/2013 | Koyama et al. | 399/328 |

FOREIGN PATENT DOCUMENTS

| | | |
|---|---|---|
| JP | 2003-076209 A | 3/2003 |
| JP | 2004-184910 A | 7/2004 |
| JP | 2008-032903 A | 2/2008 |

* cited by examiner

*Primary Examiner* — Clayton E LaBalle
*Assistant Examiner* — Warren K Fenwick
(74) *Attorney, Agent, or Firm* — Fitzpatrick, Cella, Harper & Scinto

(57) ABSTRACT

An image forming apparatus includes a main assembly; a fixing unit including a fixing rotatable member for fixing an unfixed image formed on a recording material, and a frame for accommodating the fixing rotatable member, the fixing unit is detachably mountable to the main assembly; and an air feeding member for feeding air to the fixing rotatable member provided in the main assembly, wherein the frame is provided with an opening for applying the air fed from the air feeding member to the fixing rotatable member, and an openable member movable between a first position for closing the opening and a second position for opening the opening, wherein the openable member moves from the second position to the first position in response to an operation of taking the fixing unit out of the main assembly.

16 Claims, 11 Drawing Sheets

FIXING APPARATUS, AND IMAGE FORMING APPARATUS EQUIPPED WITH FIXING APPARATUS

FIELD OF THE INVENTION AND RELATED ART

The present invention relates to a fixing apparatus (fixing device) to be mounted in an electrophotographic image forming apparatus such as a copying machine, a printer, and the like. It relates to also an image forming apparatus equipped with a fixing apparatus (fixing device).

Generally speaking a fixing apparatus (device) to be mounted in an electrophotographic image forming apparatus is provided with a rotational fixing member, which contacts a sheet of recording medium which is bearing an unfixed toner image.

By the way, it has been known that in a case where a substantial number of images are continuously formed with the use of a printer equipped with a fixing device of the so-called contact heating type, that is, a fixing device having a rotational fixing member which contacts a sheet of recording medium, the portions of rotational fixing member, which are outside the path of a sheet of recording medium, excessively increase in temperature (unwanted temperature increase across out-of-sheet-path portions of recording medium). As the out-of-sheet-path portions of a rotational fixing member excessively increase in temperature, the structural components of a fixing device are sometimes damaged by the excessive amount of heat.

There is disclosed in Japanese Laid-open Patent Application 2003-076209, a fixing apparatus which is equipped with a cooling fan for preventing the portions of the heat roller and pressure roller of the fixing device, which are outside the path of recording medium, from excessively increasing in temperature. By the way, it has been thought to structure an image forming apparatus and the fixing device therefor so that the fixing device can be removably mountable in the main assembly of the image forming apparatus, for the maintenance or replacement of the fixing device. The fixing device disclosed in Japanese Laid-Open Patent Application 2003-076209 is provided with a cooling fan, and a duct for guiding cooling air. If an image forming apparatus equipped with a fixing device having a cooling fan, and a duct for guiding cooling air, is structured so that the fixing device is removably mountable in the main assembly of the image forming apparatus, it occurs that as the fixing device is replaced, the cooling fan and cooling air duct also are replaced. Thus, a fixing device configuration such as the one disclosed in abovementioned patent application is undesirable from the standpoint of cost.

On the other hand, in consideration of the cost related to the replacement of a fixing device, it is possible to structure an image forming apparatus and the fixing device therefor in such a manner that as the fixing device is removed from the main assembly of the image forming apparatus, the cooling fan for the fixing device remains in the main assembly of the image forming apparatus. In such a case, however, the frame of the fixing device has to be provided with an opening through which cooling air is guided from the cooling fan to the rotational fixing member. With the presence of this opening, it is possible for an operator (user) of the image forming apparatus to come into contact with the rotational fixing member. Thus, it is undesirable that when the fixing device is out of the main assembly of the image forming apparatus, the opening of the fixing device, which is for guiding cooling air to the rotational fixing member of the fixing device, remains exposed.

SUMMARY OF THE INVENTION

The present invention is made in consideration of the above-described problem. Thus, the primary object of the present invention is to provide a combination of an image forming apparatus which is low in cost and yet can send cooling air into its fixing device, and a fixing device which is removably mountable in the image forming apparatus.

Another object of the present invention is to provide a fixing device, the opening of which for cooling air can be open or closed, and an image forming apparatus structured so that the fixing device is removably installable in the main assembly of the image forming apparatus.

According to an aspect of the present invention, there is provided an image forming apparatus comprising a main assembly; a fixing unit including a fixing rotatable member for fixing an unfixed image formed on a recording material, and a frame for accommodating said fixing rotatable member, said fixing unit is detachably mountable to said main assembly; and an air feeding member for feeding air to said fixing rotatable member provided in said main assembly, wherein said frame is provided with an opening for applying the air fed from said air feeding member to said fixing rotatable member, and an openable member movable between a first position for closing said opening and a second position for opening said opening, wherein said openable member moves from the second position to the first position in response to an operation of taking said fixing unit out of said main assembly.

According to another aspect of the present invention, there is provided a fixing unit detachably mountable to a main assembly of an image forming apparatus, said fixing unit comprising a fixing rotatable member; and a frame accommodating said fixing rotatable member; wherein said frame is provided with an opening for applying air fed by an air feeding member provided in the main assembly to said fixing rotatable member, and an openable member movable between a first position for closing said opening and a second position for opening said opening, wherein said openable member moves from the second position to the first position in response to an operation of taking said fixing unit out of the main assembly.

Further features of the present invention will become apparent from the following description of exemplary embodiments (with reference to the attached drawings).

DESCRIPTION OF THE PREFERRED EMBODIMENTS

Embodiment 1

(1) Example of Image Forming Apparatus

The image forming apparatus in this embodiment is an apparatus which forms an image on a sheet of recording medium, with the use of an appropriate image formation process, while the sheet is conveyed through the apparatus. Then, it outputs the print, that is, the sheet of recording medium on which the image has just been formed. The recording medium is in the form of a sheet of recording medium, on which an image can be formed. It includes a sheet of various ordinary paper, resin-coated paper, OHP film, envelops, postcards, etc, which are in a specific, or nonspecific form (which hereafter may be referred to simply as sheet).

Regarding the orientation of the image forming apparatus, the front side of the apparatus is the left side of the apparatus when the apparatus is seen from the upstream side of the sheet conveyance direction of the transfer nip of the image forming portion of the main assembly of the apparatus. The back side of the apparatus is the right side of the apparatus as seen from the upstream side of the apparatus in terms of the sheet conveyance direction of the transfer nip of the image forming portion of the main assembly of the apparatus.

Figure 1:
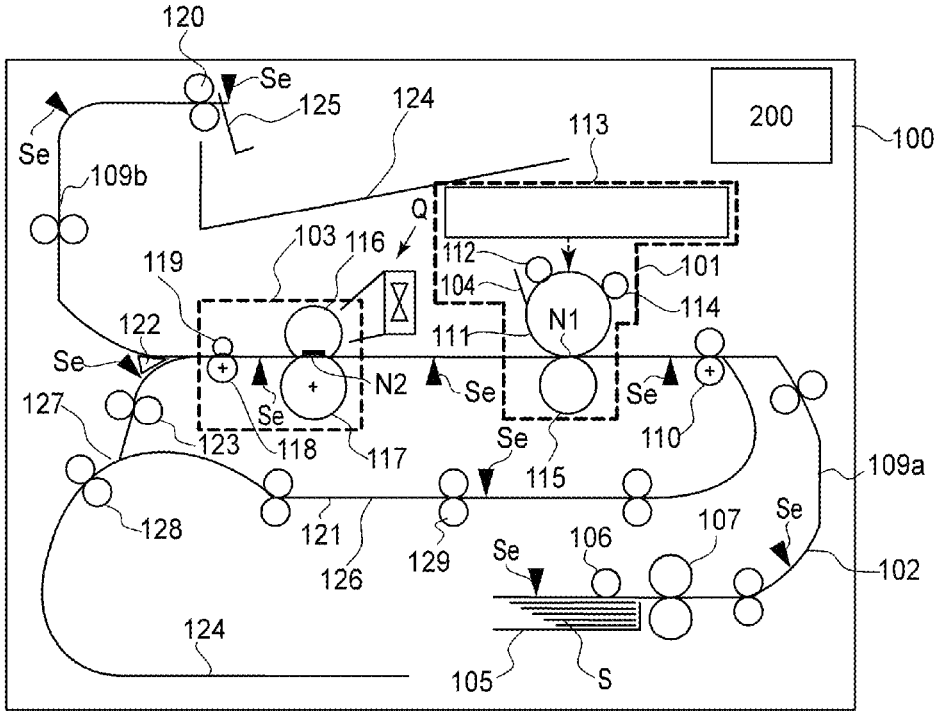
FIG. 1 is a schematic sectional view of a typical image forming apparatus to which the present invention is applicable, as seen from the front side of the apparatus, and shows the general structure of the apparatus.

FIG. 1 is a an example of image forming apparatus, as seen from the front side of the apparatus after the installation of a fixing device in accordance with the present invention into the main assembly of the apparatus. It shows the general structure of the apparatus. This image forming apparatus is an electrophotographic, digital, and monochromatic printer.

Referring to FIG. 1, designated by a numeral 100 is the main assembly of the image forming apparatus, which includes the external shell portion of the apparatus (which hereafter will be referred to simply as apparatus main assembly). There are an image forming portion 101 which forms a toner image (image) on a sheet S of recording medium, and a fixing portion (fixing device) 103 which fixes the unfixed toner image (image) formed on the sheet S, in the apparatus main assembly 100. There are also in the apparatus main assembly 100, a sheet feeder cassette 105 in which sheets S of recording medium (paper) are storable, and a sheet conveying portion 102 which conveys each sheet S of recording medium from the sheet feeder cassette 105 through the image forming portion 101 and fixing portion 103. Further, there is: a sheet turning-and-conveying portion 126 which is for turning the sheet S over after the conveyance of the sheet S through the fixing portion 103, and then, conveying the sheet S to the image forming portion 101; a control portion 200 which controls the entirety of the image forming apparatus; etc., in the apparatus main assembly 100.

The control portion 200 comprises a CPU, and memories such as a RAM and a ROM in which image formation sequences, various tables necessary for image formation, etc., are stored. The control portion 200 makes the image forming apparatus to carry out one of the image formation sequences in response to a print command issued by an external apparatus (unshown) such as a host computer or the like.

First, a case in which the control portion 200 makes the image forming apparatus to carry out an image formation sequence in response to a print command for forming an image on only one of the two surfaces of a sheet S of recording medium is described. First, an electrophotographic photosensitive member (which hereafter will be referred to as photosensitive drum) 111, which is in the form of a drum, is rotated at a preset peripheral velocity (process speed), in the image forming portion 101. As the photosensitive drum 111 is rotated, the peripheral surface of the photosensitive drum 111 is uniformly charged to preset polarity and preset potential level by a charge roller (charging means) 112 (charging process).

Next, the uniformly charged portion of the peripheral surface of the photosensitive drum 111 is scanned by (exposed to) the beam of laser light outputted from a laser beam scanner (exposing means) 113 while being modulated (turned on and off) according to the information of the image to be formed, which is sent to the scanner 113 from an external apparatus (exposing process). Consequently, an electrostatic latent image, which reflects the information of the image to be formed, is effected on the peripheral surface of the photosensitive drum 111, is formed. Then, the electrostatic latent image on the peripheral surface of the photosensitive drum 111 is developed into a visible image, that is, an image (toner image) formed of toner, by a developing device (developing means) 114 which uses toner. As for developing methods, there are jumping developing method, two-component developing method, or the like. Generally speaking, it is more likely that an electrostatic latent image is formed as an equivalent of a negative image of ordinary photography, and is reversely developed.

Meanwhile, the sheets S in the sheet feeder cassette 105 are moved out one by one from the cassette 105 with a preset sheet feeding timing by the rotation of the pickup roller 106. Then, each sheet S is conveyed by the rotation of the sheet feeding roller 107 to a pair of registration rollers 110 through a sheet conveyance guide 109*a*. The registration rollers 110 are rotated with a preset timing, whereby the sheet S is sent into the transfer nip N1, which is the area of contact between the peripheral surface of the photosensitive drum 111 and the peripheral surface of the transfer roller (transferring means) 115. Then, the sheet S is conveyed toward the fixing device 103 by being pinched between the peripheral surface of the photosensitive drum 111 and the peripheral surface of the transfer roller 115. While the sheet S is conveyed between the peripheral surface of the photosensitive drum 111 and the peripheral surface of the transfer roller 115, remaining pinched by the photosensitive drum 111 and transfer roller 115, a preset transfer bias is applied to the transfer roller 115. Consequently, the toner image on the peripheral surface of the photosensitive drum 111 is transferred onto the sheet S (transferring process).

The sheet S which is bearing the toner image transferred from the peripheral surface of the photosensitive drum 111 is introduced into the fixation nip N2 of the fixing device 103, in which heat and pressure are applied to the unfixed toner image on the sheet S. As a result, the unfixed toner is thermally fixed to the sheet S. The structure of the fixing device 103 will be described later in detail, in Section (2).

After the sheet S is conveyed out of the fixing device 103, the sheet S is discharged into a print stacking portion 124 provided outside the apparatus main assembly 100, by the combination of a sheet discharge guide 109*b*, and the rotation of a pair of discharge rollers 120.

Designated by a numeral 125 is a lever for detecting whether or not the print stacking portion 124 is full with sheets S. As it is detected by the lever 125 that the print stacking portion 124 is full with sheets S, the control portion 200 controls the image forming portion 101 so that the image forming portion 101 does not form an image on a sheet S until all the sheet S on the sheet stacking portion 124 are removed.

After the separation of the sheet S from the peripheral surface of the photosensitive drum 111, the photosensitive drum 111 is cleaned by cleaning blade 104 which is placed in contact with the peripheral surface of the photosensitive drum 111 to remove such substances as toner remaining on the peripheral surface of the photosensitive drum 111 after the transfer of the toner image from the photosensitive drum 111 (cleaning process), in order to make the peripheral surface of the photosensitive drum 111 ready to be repeatedly used for the following image formation.

In a case where the control portion 200 carries out an image formation sequence in response to a print command for forming an image on both surfaces of a sheet S of recording medium, after a sheet S is conveyed out of the fixing device 103, it is conveyed to the sheet reception roller 123 by the sheet directing portion 122 of a sheet reversing-conveying portion 126. Then, the sheet S is conveyed to a sheet reversing portion 124 through a bifurcation point 127 by the coordination between the sheet reception roller 123 and sheet reversing roller 122, and is conveyed through the sheet reversing-conveying portion 124. However, as soon as the trailing edge of the sheet S passes the bifurcation point 127, the reversing roller 128 begins to be rotated in reverse so that the sheet S begins to be conveyed toward a reversal conveyance passage 121, from the trailing edge side. Consequently, the sheet S is conveyed toward the registration rollers 110 by the rotation of a pair of sheet conveyance rollers 129.

Then, the registration rollers 110 send the sheet S into the transfer nip N1 of the image forming portion 101 with a preset timing. In the image forming portion 101, each of the above described processes of charging, exposing, developing, and transferring is carried out to form an unfixed toner image on the surface of the sheet S, on which an image has not been formed. Then, the sheet S is introduced into the fixation nip N2 of the fixing device 103, in which heat and pressure are applied to the sheet S and the unfixed toner image thereon. Consequently, the unfixed toner image is thermally fixed to the surface of the sheet S. After being conveyed out of the fixing device 103, the sheet S is discharged into the print stacking portion 124 by the coordination between the sheet discharge guide 109*b* and the rotation of the discharge rollers 120.

Referring to FIG. 1, a referential code S3 stands for a sheet sensor which detects a sheet S of recording medium. The apparatus main assembly 100 is provided multiple sheet sensors S2, which are positioned at the sheet feeder cassette 105, and various preset points, one for one, of the recording medium conveyance passage of the apparatus main assembly 100.

The image forming apparatus is enabled to deal with various types of sheet S of recording medium, in terms of width and length. Therefore, in an image forming operation in which a substantial number of sheets S, the width of which is narrower than the width of the widest sheet S conveyable through (introducible into) the apparatus, are continuously conveyed through the fixing device 103 in such a manner that in terms of the widthwise direction of the recording medium passage of the fixing device 103, the center of each sheet S coincides with the center of the recording medium conveyance passage, or the edge of the sheet S coincides with the corresponding edge of the recording medium passage, there occurs the phenomenon that the portions of the rotational fixing member of the fixing device 103, which are outside the recording medium path, excessively increases in temperature. As will be described later in detail, a widest sheet of recording medium conveyable through the fixing device 103 will be referred to as a largest sheet, and a sheet of recording medium which is narrower than the largest sheet will be referred to as a narrow sheet. Here, "sheet width" means the dimension of a sheet, in terms of the direction perpendicular to the sheet conveyance direction, when a sheet of recording medium is being conveyed through the sheet conveyance passage.

The image forming apparatus in this embodiment is provided with a cooling device Q for prevent the problem that in terms of the widthwise direction of the recording medium passage of the fixing device 103, the portions of the rotational fixing member of the fixing device 103, which are outside the recording medium path, excessively increase in temperature. The cooling device Q is positioned on the upstream side of the fixing device 103 in terms of the sheet conveyance direction. This cooling device Q will be described later in detail in Section (6).

(2) Fixing Device (Fixation Unit) 103

(2-1) General Structure of Fixing Device (Fixation Unit) 103

Figure 2:
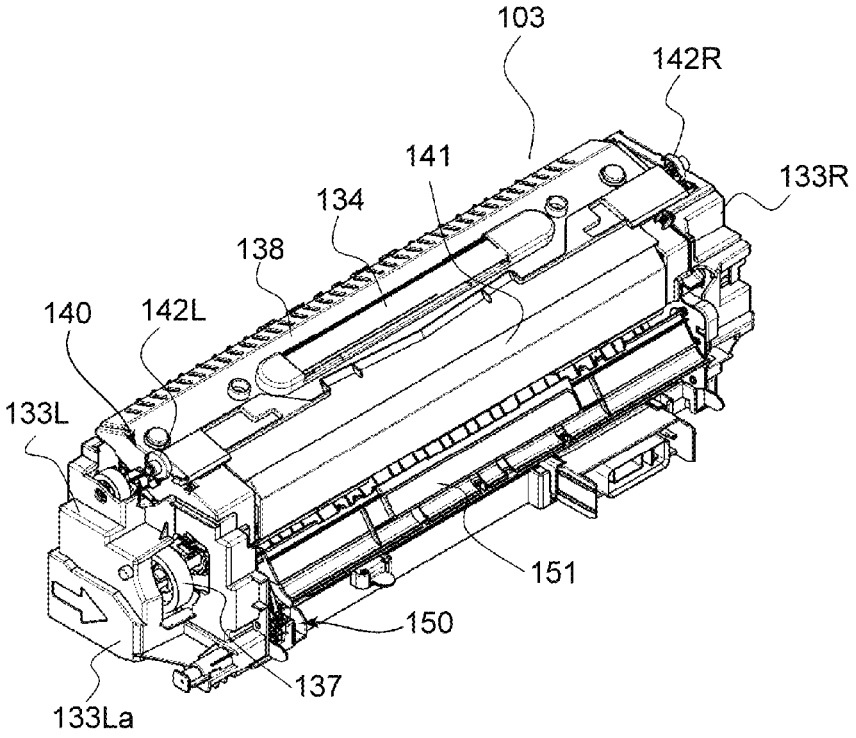
FIG. 2 is a perspective view of the fixing device, as seen from diagonally above the left and upstream corner (in terms of recording medium conveyance direction), after the removal of the fixing device from the main assembly of the image forming apparatus shown in FIG. 1.
Figure 3:
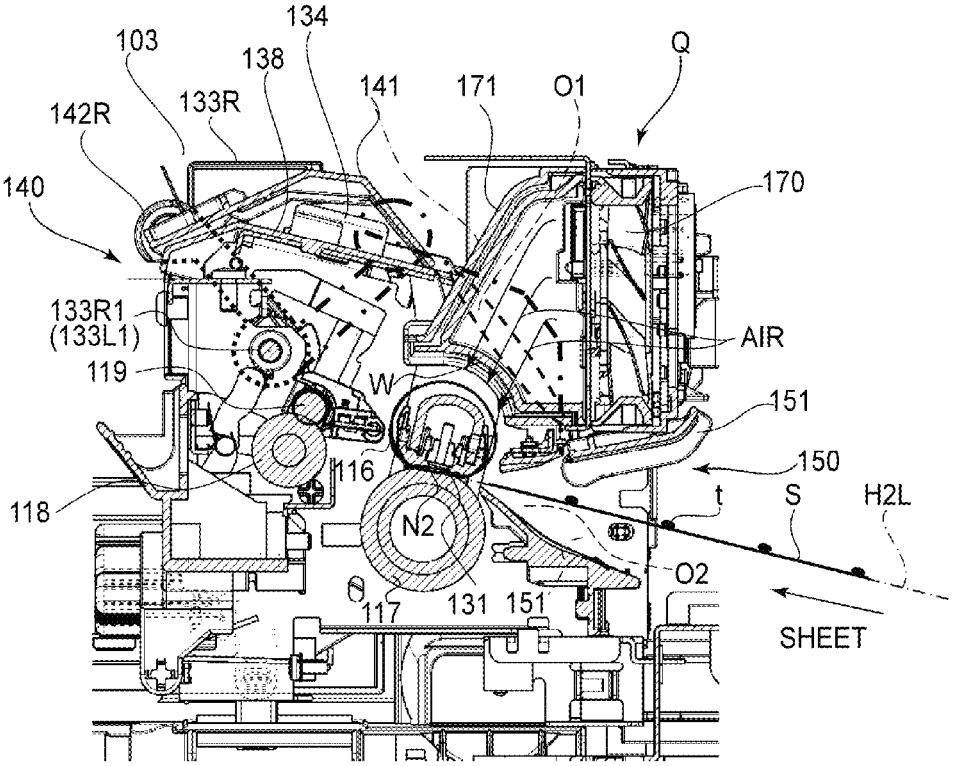
FIG. 3 is a cross-sectional view of the fixing device, as seen from the front side of the image forming apparatus, when the fixing device is in the normal position in the image forming apparatus.

FIG. 2 is a perspective view of the fixing device 103 as seen from diagonally above the left and upstream (in terms of sheet conveyance direction) corner of the fixing device 103, when the fixing device 103 is out of the apparatus main assembly 100. It shows the state of the fixing device 103, in which the shutter (member which can be opened or closed) 141 and rotationally movable entrance guide 151 of the fixing device 103 are closed. FIG. 3 is a cross-sectional view of the fixing device 103, as seen from the front side of the apparatus main assembly 100 when the fixing device 103 is in its normal position in the apparatus main assembly 100. It shows the state of the fixing device 103, in which the shutter 141 and rotationally movable entrance guide 151 of the fixing device 103 are open. The rotationally movable guide 151 plays the role of guiding a sheet S into the fixing device 103.

A state in which the shutter 141 is closed is such a state that the shutter 141 is in a position (first position) in which its keeps covered the opening O1 (FIG. 3) of the fixing device 103, which will be described later, as indicated by a single-dot chain line in FIG. 3. A state in which the shutter 141 is open is such a state that the shutter 141 is in a position (second position) in which its keeps exposed the opening O1 as indicated by a solid line in FIG. 3. A state in which the rotationally movable entrance guide 151 is closed is such a state that the rotationally movable entrance guide 151 is in a position in which it keeps covered the nip entrance O2 (FIG. 3) of the fixing device 103. A state in which the rotationally movable entrance guide 151 is open is such a state that the rotationally movable entrance guide 151 is in a position in which the rotationally movable guide 151 keeps the nip entrance O2 exposed.

Figure 4:
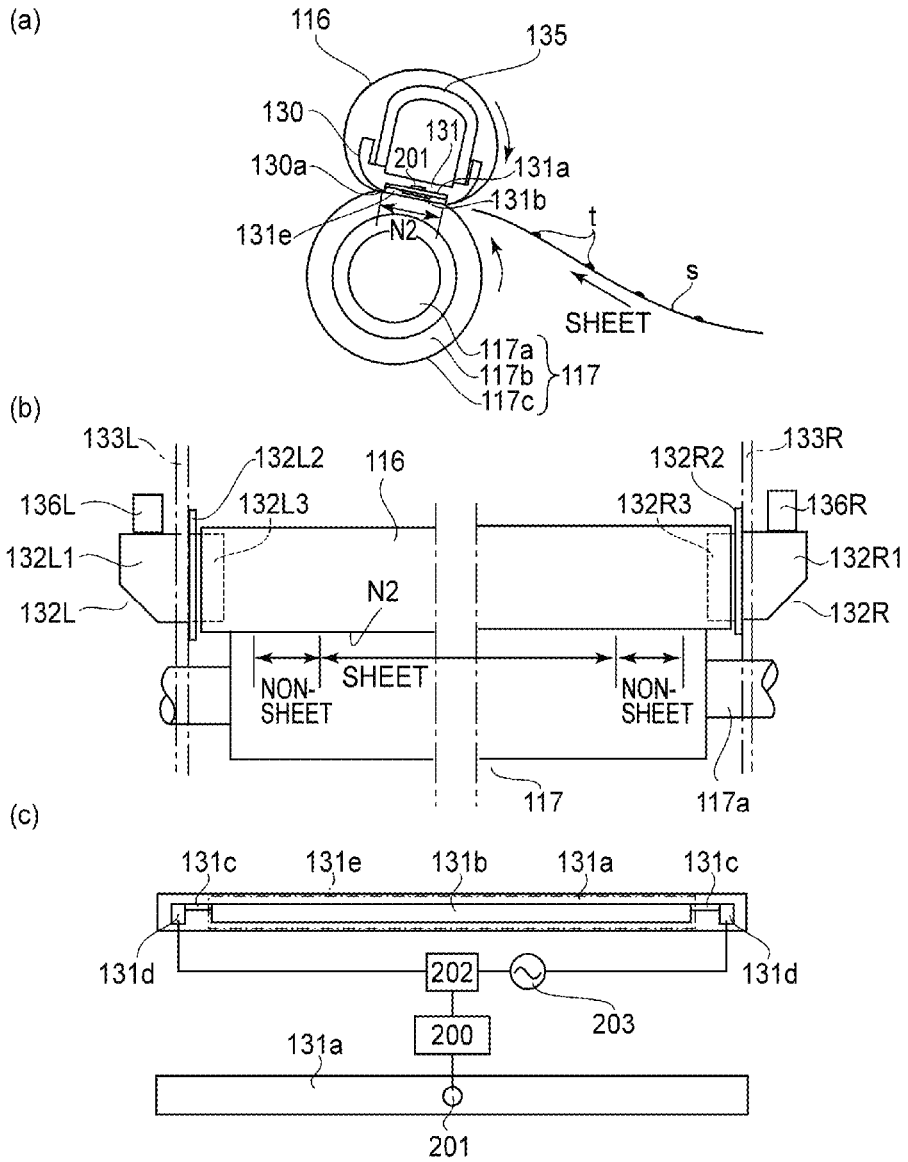
FIG. 4 is a schematic drawing of the essential portions of the fixing device.

FIG. 4 is a schematic drawing of the essential portions of the fixing device 103. FIG. 4(*a*) is a cross-sectional view of the essential portions of the fixing device 103, and shows the interior of the fixing device 103. FIG. 4(*b*) is a side view of the essential portions of the fixing device 103, as seen from the upstream side of the fixing device 103 in terms of the sheet conveyance direction. FIG. 4(*c*) is a side view of the ceramic heater 140 of the fixing device 103, and shows the general structure of the heater 140. This fixing device 103 is of such a type that has a fixation belt (which hereafter may be referred to as rotational fixing member or fixation film). It heats the unfixed toner image on a sheet S of recording medium with the use of the fixation belt.

Referring to FIGS. 4(*a*) and 4(*b*), designated by numerals 135 and 130 are a stay (rigid member) and a heater holder (heating member supporting member), respectively. Designated by numerals 131 and 116 are a ceramic heater (heating generating member) as a heat source, and a cylindrical fixation belt (first rotational member) as a rotational fixing member, respectively. Designated by numerals 117, 132L, and 132R are a pressure roller (second rotational member), and a pair of flanges (regulating members) which regulate the fixation belt 116 in lateral shift, respectively.

The stay 135 is roughly U-shaped in cross-section. It is formed by bending a piece of metallic plate. It is heat resistant and rigid. The heater holder 130 is formed of heat resistant resin. The stay 135 and heater holder 130 are put together so that the stay 135 is placed on the upwardly facing surface of the heater holder 130 to reinforce the heater holder 130 with the stay 135.

The heater 131 has a long and narrow heater substrate (which hereafter will be referred to simply as substrate) 131*a* formed of highly heat resistant ceramic. The heater 131 has a heat generating resistor 131*b*, which was formed on the downwardly facing surface of the substrate 131*a* by printing, in such an attitude that the lengthwise direction of the heat generating resistor 131*b* becomes parallel to the lengthwise direction of the substrate 131*a*. The heat generating resistor 131*b* generates heat as electric current is flowed through it. Further, the heater 131 has a pair of electrically conductive portions 131*c* for supplying the heat generating resistor 131*b* with electric power, and a pair of electrodes 131*d* for supplying the heat generating resistor 131*b* with electric power through the electrically conductive portions 131*c*. The electrically conductive portions 131*c* and electrodes 131*d* were formed also by printing, on the downwardly facing surface of the substrate 131*b*. Further, the heater 131 is provided with a glass layer (protective layer) 131*e* coated on the downwardly facing surface of the substrate 131*b* in a manner to cover the heat generating resistor 131*b* to protect the resistor 131*b*.

The heat holder 130 is provided with a groove 130*a*, which is in the downwardly facing surface of the heater holder 130 and extends in the lengthwise direction of the holder 130. It is in this groove 130*a* that the heater 131 is held.

The stay 135 and heater 131 are attached to the heater holder 130, and the fixation belt 116 is loosely fitted around the combination of the stay 135, heater 131, and heater holder 130.

Referring to FIG. 4(*b*), there are disposed a pair of belt flanges 132L and 132R at the lateral edges of the fixation belt 116, one for one. The belt flanges 132L and 132R have base portions 132L1 and 132R1, regulating portions 132L2 and 132R2, guiding portions 132L3 and 132R3, etc., respectively.

The base portions 132L1 of the belt flange 132L are supported by the frame 133L of the fixation unit. The base portion 132R1 of the belt flange 132R is supported by the frame 133R of the fixation unit.

The regulating portions 132L2 and 132R2 are for regulating the movement of the fixation belt 116 in the thrust direction of the fixation belt 116, which occurs as the fixation belt 116 is circularly driven. The guiding portions 132L3 and 132R3 are for guiding the fixation belt 116 from the inward side of the fixation belt 116 while the fixation belt 116 is circularly driven.

The pressure roller 117 has a metallic core 117*a*, and an elastic layer 117*b* which covers most of the peripheral surface of the metallic core 117*a*. As for the material for the elastic layer 117*b*, heat resistant solid rubber such as silicone rubber, fluorinated rubber, or the like, can be used. Further, the pressure roller 117 is provided with a parting layer 117*c* which was formed of fluorinated resin or the like in a manner to cover the entirety of the outward surface of the elastic layer 117*b*. The pressure roller 117 is disposed so that it opposes the heater 131, with the presence of the fixation belt 116 between itself and the heater 131. The lengthwise end portions of the metallic core 171*a* of the pressure roller 117 are rotatably supported by the frames 133L and 133R of the fixation unit, with the placement of a pair of bearings 133L and 133R between the metallic core 117*a* and frames 133L and 133R, respectively.

Further, the fixing device 103 is provided with a pair of pressure plates 136L and 136R, which are disposed so that they remain pressed upon the upwardly facing surfaces of the base portions 132L1 and 132R1 of the belt flanges 132L and 132R, respectively, by a pair of compression springs (unshown).

Since the pressure plates 136L and 136R are under the pressure from this pressure applying mechanism, the belt flanges 132L and 132R are made to press the heater holder 130 with the presence of the stay 135 between themselves and the heater holder 130. Thus, the heater 131 is kept pressed upon the pressure roller 117 with the presence of the fixation belt 117 between itself and the pressure roller 117. Thus, the elastic layer 3*b* of the pressure roller 3*b* 117*b* of the pressure roller 117 is elastically deformed by the pressure applied to the pressure roller 117 by the heater 131, creating thereby the fixation nip N2 between the outward surface of the fixation belt 116 and peripheral surface of the pressure roller 117.

The pressure applying mechanism has a pressure relieving mechanism which is for removing the pressure from the heater holder 130 to make it easier to remove a jammed sheet S from the fixing device 103.

(2-2) Thermally Fixing Operation of Fixing Device 103

The control portion 200 begins to rotationally drive the motor (unshown) of the fixing device 103 in response to a print start command. The rotation of the output shaft of this motor is transmitted to a pressure roller gear 137 (FIG. 2), with which the metallic core 1107*a* of the pressure roller 117 is fitted, through a preset speed reduction gear train (unshown). Consequently, the pressure roller 117 rotates in the direction indicated by an arrow mark (FIG. 4(*a*)). The rotation of the pressure roller 117 is transmitted to the fixation belt 116 by the friction which occurs between the peripheral surface of the pressure roller 117 and fixation belt 116, in the fixation nip N2. Thus, the fixation belt 116 rotates in the direction indicated by an arrow mark (FIG. 4(*a*)), following the rotation of the pressure roller 117, with the inward surface of the fixation belt 116 remaining in contact with the surface of the glass coat layer 131*e* of the heater 131.

The inward surface of the fixation belt 116 is coated with grease (lubricant), which ensures that the fixation belt 116 smoothly slides on the combination of the heater 140 and heater holder 142.

The control portion 200 takes in the detection signals (output signals) outputted from the thermistor (temperature detecting means) 210 disposed at the mid portion of the heater 131 in terms of the lengthwise direction of the heater 131, and determines the duty ratio by which electric power is to be supplied to the heat generating resistor 131*b*, based on these detection signals. Then, it controls a triac 202 based on this duty ratio, to maintain the temperature of the heater 131 at a preset fixation temperature (target temperature level).

As a sheet S on which an unfixed toner image is borne is conveyed through the fixation nip while the motor is rotationally driven, and the temperature of the heater 113 is kept at the target temperature level, the toner image is fixed to the sheet S.

After being conveyed out of the fixation nip N2, the sheet S is conveyed to the sheet conveyance passage, which is on the downstream side of the fixing device 103 in terms of the sheet conveyance direction, while remaining pinched by sheet discharge rollers 118 and 119 (FIG. 3).

(3) Structure of Mechanism 140 for Opening or Closing Shutter 141

Figure 7A:
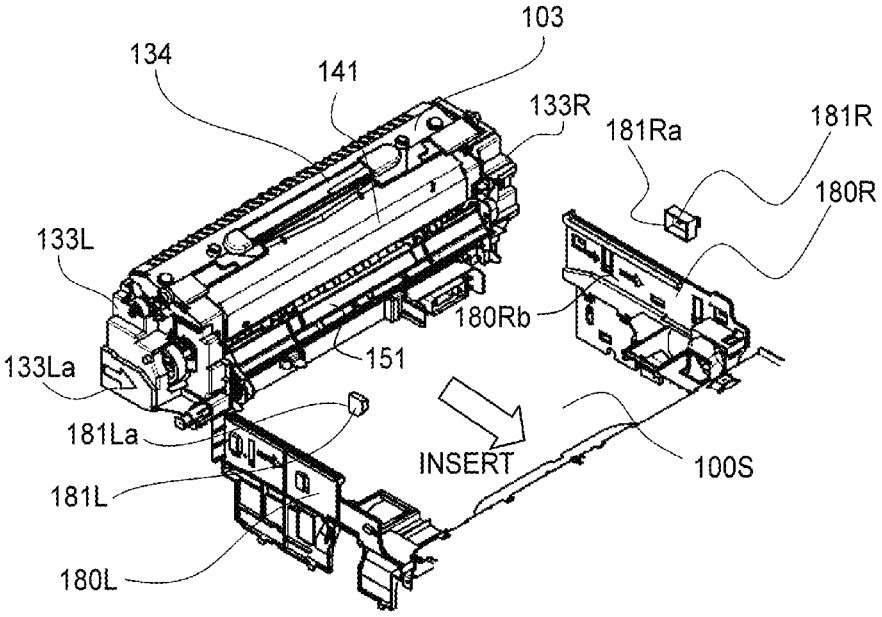
FIG. 7A is a drawing (1) for describing how the fixing device is to be installed into the main assembly of the image forming apparatus.
Figure 7B:
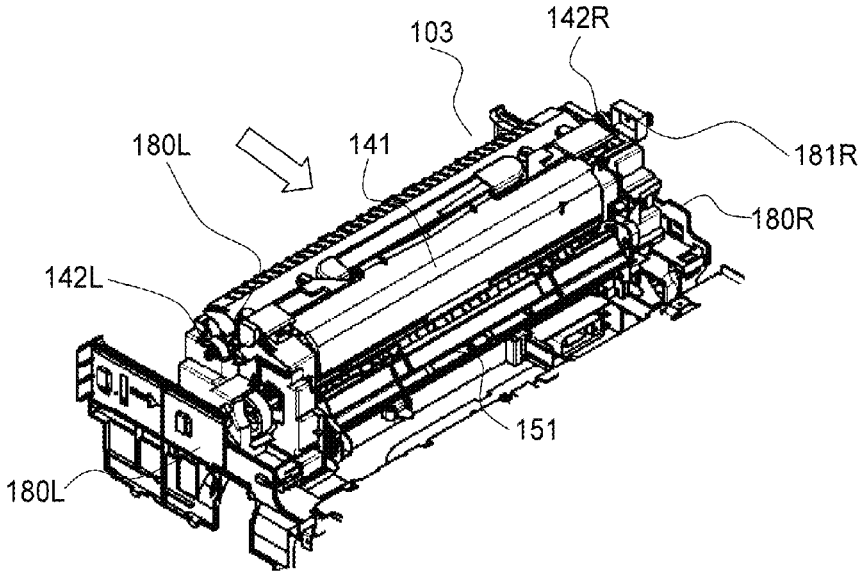
FIG. 7B is a drawing (2) for describing how the fixing device is to be installed into the main assembly of the image forming apparatus.
Figure 7C:
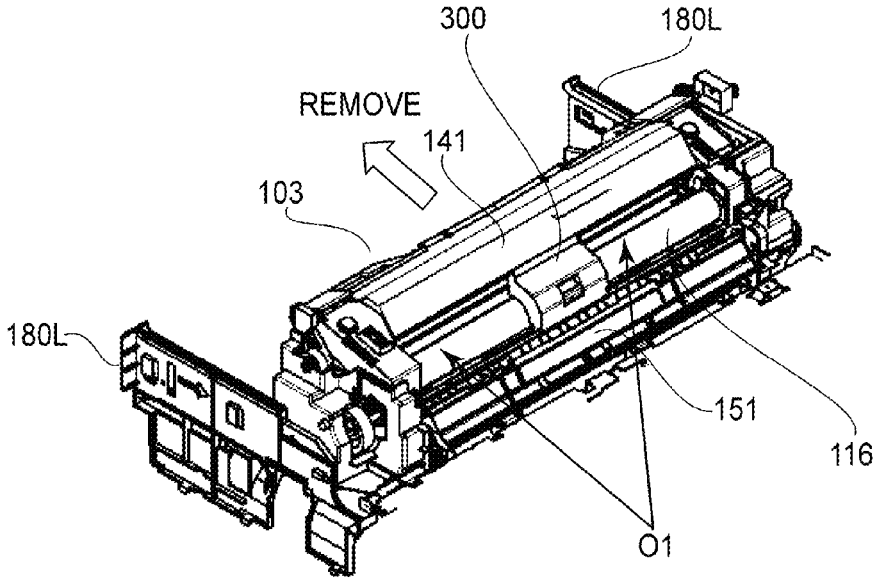
FIG. 7C is a drawing (3) for describing how the fixing device is to be installed into the main assembly of the image forming apparatus.

Referring to FIGS. 3 and 7C, the frame (frame 133) of the fixing device 103 is provided with the openings O1 which oppose the different portions of the fixation belt 116 from the fixation nip (N2) portion of the fixation belt 116, in terms of the circumferential direction of the fixation belt 116. These opening O1 are for allowing the cooling duct 171 of the cooling device Q with which the apparatus main assembly 100 is provided to cool the lengthwise end portions (out-of-sheet-path portions) of the rotational fixing member of the fixing device 103, to be inserted into the fixing device 103. Further, the frame (133) of the fixing device 103 is provided with a nip entrance O2, which is on the upstream side of the fixation nip N2, in terms of the sheet conveyance direction. This nip entrance O2 is for guiding a sheet S of recording medium into the fixation nip N2.

Referring to FIG. 2, the fixing device 103 is provided with the first mechanism 140 having the shutter 141 for exposing or covering the openings O1, and the second mechanism 150 having the guide 151 which plays the role of guiding a sheet of recording medium to the fixation nip, and also, the role of exposing or covering the nip entrance O2.

The rotational axle 133R1 (133L1) of the first opening-closing mechanism 140 is disposed on the downstream side of the fixation nip N2 in terms of the sheet conveyance direction. The shutter 141 is rotationally moved about the axle 133R1 (133L2) by the operation for installing the fixing device 103 into the apparatus main assembly 100.

Further, the opening-closing mechanism 140 is structured so that as the fixing device 103 is moved out of the apparatus main assembly 100, the shutter 141 is positioned above the fixation belt 116 to cover the opening O1, by the movement of the fixing device 103. This shutter position above the fixation belt 116 is indicated by a single-dot chain line in FIG. 3.

That is, the apparatus main assembly 100 and fixing device 103 are structured so that as the fixing device 103 is inserted into the apparatus main assembly 100, the shutter 141 is moved by the inward movement of the fixing device 103, into the position in which the shutter 141 exposes the opening O1, and also, so that as the fixing device 101 is moved out of the apparatus main assembly 100, the shutter 141 is moved by the outward movement of the fixing device 103, into the position in which the shutter 103 covers the opening O1.

Figure 5:
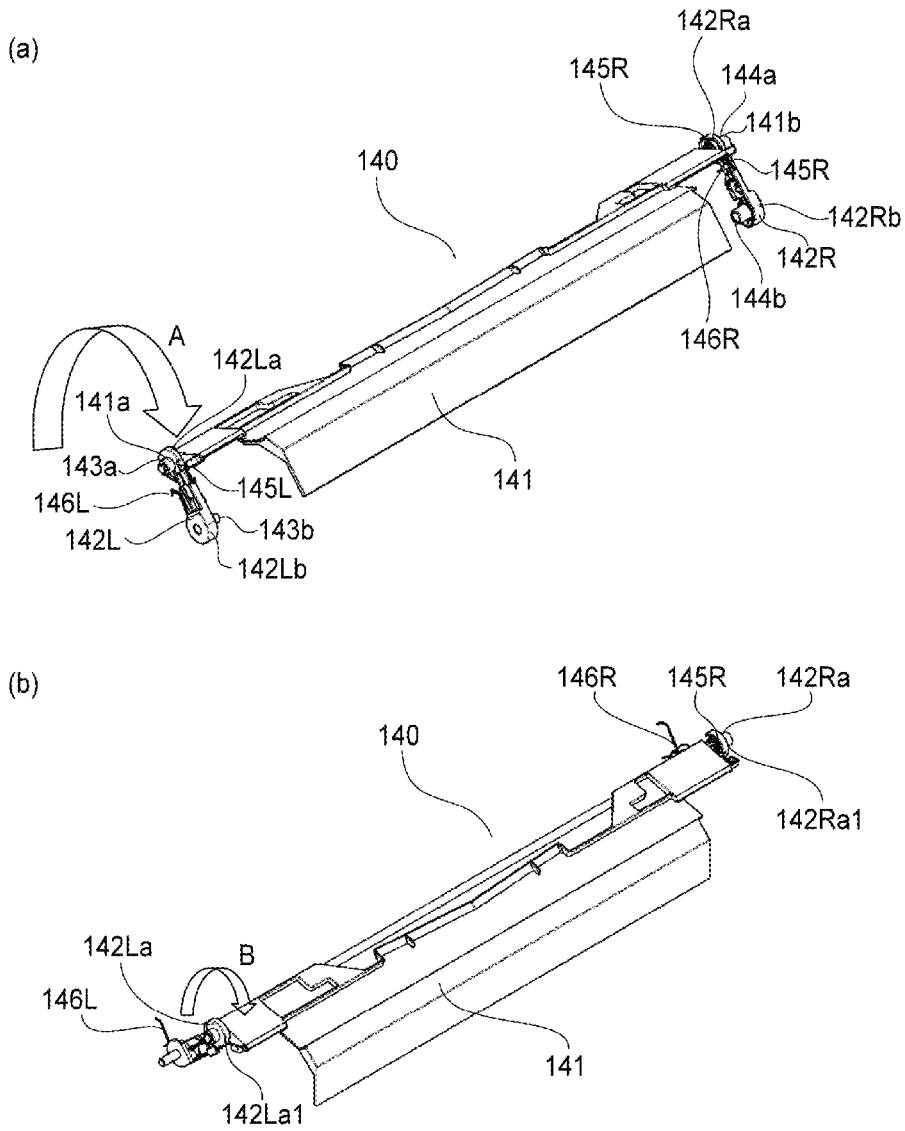
FIG. 5 is a perspective view of the mechanism for controlling the shutter of the fixing device, and shows the general structure of the mechanism.

FIG. 5 is a perspective view of the opening-closing mechanism 140, and shows the general structure of the opening-closing mechanism 140. More specifically, FIG. 5(*a*) is a perspective view of the opening-closing mechanism 140 when the shutter 141 is open, and FIG. 5(*b*) is a perspective view of the opening-closing mechanism 140 when the shutter 141 is closed.

Referring to FIGS. 2 and 6, the opening-closing mechanism 140 has a long and narrow shutter 141, a pair of arms 142L and 142R which support the lengthwise ends of the shutter 141, one for one, etc. The shutter 141 is provided with a pair of shafts 141*a* and 141*b*, which are integral parts of the length end portions of the shutter 141, and are rotatably supported by the arms 142L and 142R, respectively. Further, the arms 142L and 142R are rotationally movable about a pair of rotational centers 142Lb and 142Rb, which are rotatably supported by the frame 133L and 133R of the fixation unit, making up the rotational axles 133L1 and 133R1, respectively.

The arms 142L and 142R have engaging ends 142La and 143Ra, which are the top end portions of the arms 142L and 142R, respectively. They have also the rotational center portions 142Lb and 142Rb, which are the bottom portions of the arms 142L and 142R, respectively. The engaging end portions 142La and 142Ra of the arms 142L and 142R are provided with holes 143*a* and 144*a*, respectively. The rotational center portions 142Lb and 142Rb are provided with shafts 143*b* and 144*b* having a hole (which hereafter may be referred to as hollow shafts).

The shaft portions 141*a* and 141*b* of the shutter 141 fit into the holes 143*a* and 144*a* of the engaging end portions 142La and 142Rra, whereby the shutter 141 is rotatably supported by the engaging end portions 142La and 142Ra. The shaft portions 133L1 and 133R1 of the frames 133L and 133R of the fixation unit (FIG. 3) are fitted in the holes of the hollow shaft portions 143*b* and 144*b* of the arms 142L and 142R, whereby the arms 142L and 142R are rotatably supported by the frames 133L and 133R of the fixation unit, respectively.

The arms 142L and 142R are under the pressure generated by the torsional coil springs 146L and 146R, with which the hollow shaft portions 143*b* and 144*b* are provided, in the direction to rotate the arm 142L and 142R about the shaft portion 143*b* and 144B, respectively. The direction indicated by the arrow mark A is the direction in which the shutter 141 is rotated to cover the opening O1. Further, the shutter 141 is under the pressure generated by the torsional coil springs 145L and 145R, with which the shaft portion 141*a* and 141*b* is provided, in the direction to rotationally move the shutter 141 about the shaft portion 141*a* and 141*b* in the direction indicated by an arrow mark B. The direction indicated by the arrow mark B is also the direction in which the shutter 141 is moved to cover the opening O1, like the direction indicated by the arrow mark A.

The engaging end portions 142La and 142Ra are provided with engaging portions 142La1 and 142Ra1, which are located at preset positions of the peripheral surfaces of the engaging end portions 142La and 142Ra, respectively, to control the opening and closing of the shutter 141.

(4) Structure of Mechanism 150 for Opening and Closing Guide

The guide opening-closing mechanism 150 is disposed on the upstream side of the fixation nip N2 of the fixing device 103 in terms of the sheet conveyance direction. It is structured so that as the front door FD (FIG. 6A) of the apparatus main assembly 100, which can be opened or closed is closed (moved in direction indicated by arrow mark P1), the guide 151 is retracted into a position, which is a preset distance apart from a hypothetical extension (line) N2L of the fixation nip N2 (FIG. 3), to expose the nip entrance opening O2. This hypothetical extension (line) N2L is such a line that is perpendicular to the line which connects the center of the fixation belt 116 and the center of the pressure roller 117, and is tangential to the outward surface of the fixation belt 116 and the peripheral surface of the pressure roller 117. The position in which the guide 151 is after being retracted is contoured by a solid line in FIG. 3. The apparatus main assembly 100 is structured so that when the guide 151 is in this position of retraction, the guide 151 guides an upwardly curled sheet S of recording medium to the fixation nip N2.

Further, the guide opening-closing mechanism 150 is structured so that as the door on the front side (which hereafter will be referred to as front door) FD is opened (moved in direction indicated by arrow mark P2), the guide 151 is moved in the direction perpendicular to the theoretical extension (line) N2L in a manner to cover the nip entrance opening O2. The position in which the guide 151 is when it became perpendicular to the theoretical extension (line) N2L is shown in FIG. 6C.

That is, the guide opening-closing mechanism 150 is structured so that as the front door FD is closed, the guide 151 is rotationally moved into the position in which it keeps the nip entrance opening O2 exposed, whereas as the front door FD is opened, the guide 151 is rotationally moved into the position in which it keeps the nip entrance opening O2 covered.

Figure 6A:
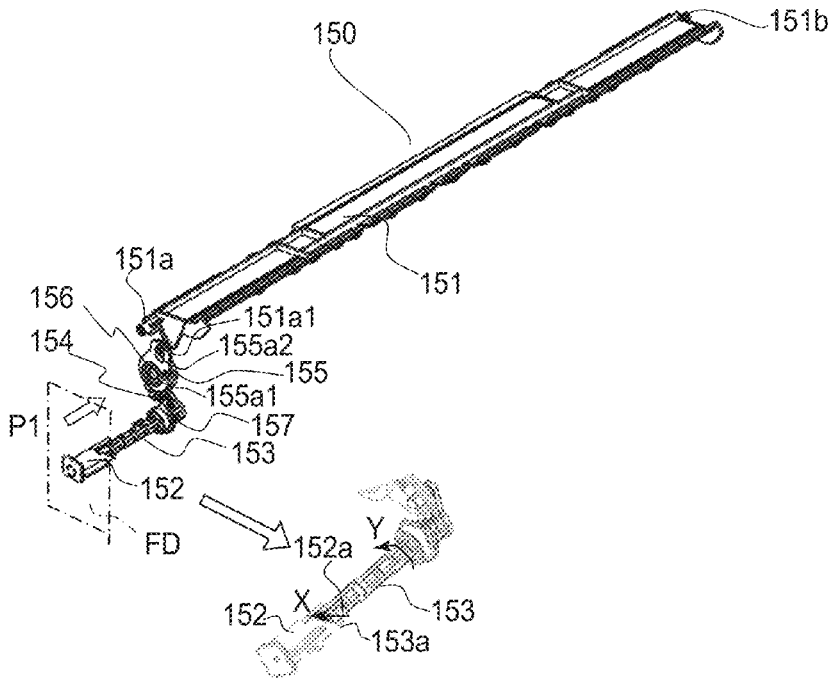
FIG. 6A is a perspective view of the mechanism for controlling the rotatably movable entrance guide of the fixing device, and shows the general structure of the mechanism.
Figure 6B:
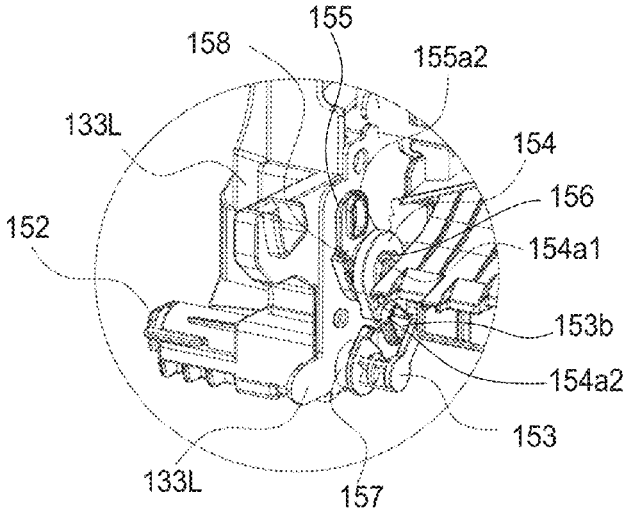
FIG. 6B is a perspective view of the mechanism for controlling the rotatably movable entrance guide of the fixing device, and shows the general structure of the mechanism.
Figure 6C:
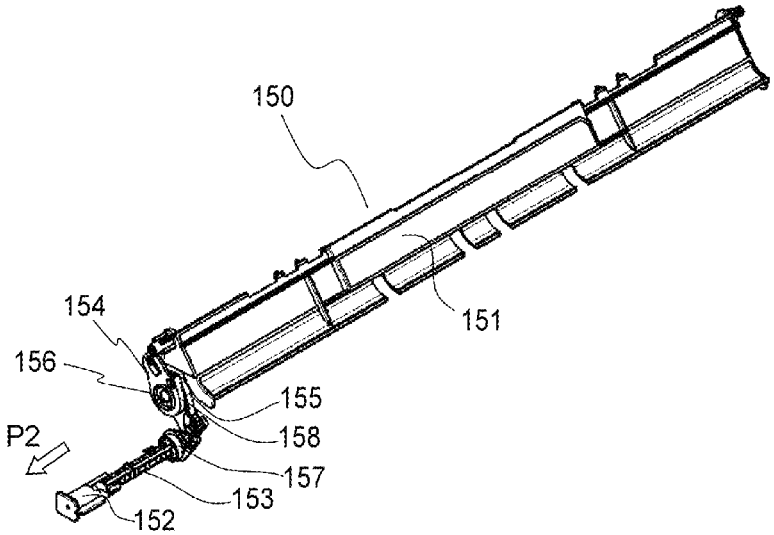
FIG. 6C is a perspective view of the mechanism for controlling the rotatably movable entrance guide of the fixing device, and shows the general structure of the mechanism.
Figure 6D:
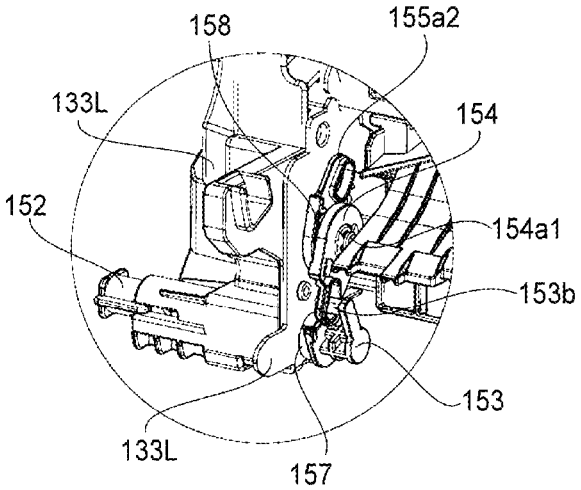
FIG. 6D is a perspective view of the mechanism for controlling the rotatably movable entrance guide of the fixing device, and shows the general structure of the mechanism.

FIGS. 6A-6D are perspective views of the guide opening-closing mechanism 150, which shows the general structure of the mechanism 150. More specifically, FIG. 6A is a perspective view of the guide opening-closing mechanism 150 when the guide 151 is open, and FIG. 6B is an enlarged perspective view of the guide opening-closing mechanism 150, as seen from the rear side of the mechanism 150 when the mechanism 150 is in the state shown in FIG. 6A. FIG. 6C is a perspective view of the mechanism 150 when the guide 151 is closed, and FIG. 6D is an enlarged perspective view of the mechanism 150 when the mechanism 150 is in the state shown in FIG. 6C. Incidentally, in order to prevent FIGS. 6B and 6C from appearing unnecessarily complicated, the guide 151 is not shown in the two drawings.

Referring to FIGS. 2 and 6, the guide opening-closing mechanism 150 has: the long and narrow guide 151, an opening-closing button 152, a camshaft 153, a linkage plate 154, a linkage plate 155, etc.

The opening-closing button 152 is attached to the frame 133L of the fixation unit in such a manner that it can be slid in the lengthwise direction of the guide 151. The opening-closing button 152 is under the pressure generated by a spring (unshown) generated in the direction (indicated by arrow mark P2) to make the button 152 protrude frontward (leftward in drawing) of the fixing device 103.

The camshaft 153 is rotatably supported by the frame 133L of the fixation unit, and is in contact with the opening-closing button 152. The surface 152*a* of the opening-closing button 152, which faces the camshaft 153, and the surface 152*b* of the camshaft 153, which faces the opening-closing button 152, are slanted (hence, slanted surfaces 152*a* and 153*a*) at such angles that the linear movement of the opening-closing button 152 is converted into the rotational movement of the camshaft 153. That is, as the opening-closing button 152 is moved in the direction indicated by the arrow mark P1 (by being pushed by front door FD), the slanted surface 153*a* of the camshaft 153 is moved in the direction indicated by an arrow mark X, following the slanted surface 152*a* of the opening-closing button 152. Consequently, the camshaft 153 rotates in the direction indicated by an arrow mark Y.

One of the lengthwise end portions of the linkage plate 154 is provided with a hole 154*a*1, whereas the other lengthwise end portion of the linkage plate 154 is provided with an elongated hole 154*a*2. It is in the hole 154*a*1 that a linkage plate shaft 156 fixed to the frame 133L of the fixation unit is fitted. It is in the elongated hole 154*a*2 that the boss 153*b* with which the camshaft 153 is provided is fitted. The linkage plate 154 is rotationally moved about the linkage plate shaft 156 by the rotation of the camshaft 153.

One of the lengthwise end portions of the linkage plate 155 is provided with a hole 155*a*1, and the other lengthwise end portion of the linkage plate 155 is provided with an elongated hole 155*a*2. It is in the hole 155*a*1 that the linkage plate shaft 156 is fitted in such a manner that the axial line of the hole 155*a*1 coincides with the axial line of the linkage plate shaft 156. This linkage plate 155 is rotationally moved about the linkage plate shaft 156 by the rotational movement of the linkage plate 154.

One of the lengthwise end portions of the guide 151 has a shaft 151*a*, and the other lengthwise end portion of the guide 151 has a shaft 151*b*. The shafts 151*a* and 151*b* are fitted in the holes (unshown) of the frames 133L and 133R of the fixation unit, being thereby rotatably supported by the frames 133L and 133R of the fixation unit, respectively. Further, the end of the shaft 151*a* of the guide 151 has a sub-shaft 151*a*1, which is fitted in the elongated hole 155*a*2 of the linkage plate 155. Thus, the guide 151 is rotationally moved about the shafts 151*a* and 151*b* by the rotational movement of the linkage plate 155.

Further, there is disposed a return spring 157 between the frame 133L of the fixation unit and the camshaft 153. There is also disposed a return spring 158 between the linkage plates 154 and 155.

With the provision of the above described structural arrangement, as the front door FD is closed, whereby the opening-closing button 152 is pushed inward of the apparatus main assembly 100, the linkage plate 155 is rotated by the movement of the opening-closing button 152, whereby the guide 151 is rotationally moved by the edge of the elongated hole 155*a*2 of the linkage plate 155 in the direction to expose the nip entrance opening O2. More concretely, the structural arrangement is such that the opening-closing button 152 is pushed inward of the apparatus main assembly 100 by the protrusion (unshown) with which the front door FD is provided. Therefore, when the front door FD remains closed (when apparatus is in normal operation), the guide 151 remains open (FIG. 6A), allowing a sheet S of recording medium to be introduced into the fixation nip N2. FIG. 6B shows the positions in which the linkage plates 154 and 155 are when the guide 151 is in the position shown in FIG. 6A.

As the front door FD is opened, the opening-closing button 152 protrudes toward the front door FD, allowing thereby the linkage plate 155 to rotate. Thus, the guide 151 is rotationally moved by the edge of the elongated hole 155*a*2 of the linkage plate 155 in the direction to cover the nip entrance O2. That is, when the front door FD is open, the guide 151 remains closed (FIG. 6C), preventing thereby a sheet S of recording medium from being introduced into the fixation nip N2. FIG. 6D shows the positions in which the linkage plates 154 and 155 are when the guide 151 is in the position shown in FIG. 6C.

(5) Structure of Rails 180L and 180R, and Guide 181L and 181R.

FIGS. 7A, 7B and 7C are drawings for describing how to install the fixing device 103 into the fixation device space 100S in the apparatus main assembly 100.

Referring to FIG. 7A, the apparatus main assembly 100 has a pair of rails 180L and 180R for guiding the fixing device 103 into the apparatus main assembly 100, and a pair of guides 181L and 182R for rotationally moving the arms 142L and 142R of the opening-closing mechanism 140. The rails 180L and 180R are attached to the left and right lateral plates (unshown) of the apparatus main assembly 100, and are provided with guiding groove 180La and 180Rb, which are inwards side of the lateral plates, and along which the fixing device 103 can be roughly horizontally pulled out of, or inserted into, the fixation device space 100S. Although FIG. 7A does not show the guiding groove 180La of the rail 180L, the guiding groove 180La is the same in shape as the guiding groove 180Rb.

The guides 181L and 181R also are attached to the left and right lateral plates (unshown) of the apparatus main assembly 100, being positioned above the rails 180L and 180R, respectively. Further, the guide 181L and 181R have guiding surfaces 181La and 181Ra, which come into contact with the engaging portions 142La1 and 142Ra1 of the arms 142L and 142R, respectively.

The outward surfaces of the covers 133L and 133R of the fixing device 103 are provided with guiding protrusions 133La and 133Rb, respectively (FIGS. 2 and 7A). Although FIGS. 2 and 7A do not show the guiding protrusion 133Rb of the cover 133R, the guiding protrusion 133Rb is the same in shape as the guiding protrusion 133La of the cover 133L. Further, the top stay 138, which is one of the top portions of the fixing device 103, is provided with a handle to be used to remove the fixing device 103 from the apparatus main assembly 100.

When it is necessary to install the fixing device 103 into the apparatus main assembly 100, an operator is to open the side cover (unshown), with which the apparatus main assembly 100 is provided, and which is placed on the sheet discharge guide (109*b*) side (FIG. 1) of the apparatus main assembly 100, to expose the fixing device space 100S of the apparatus main assembly 100. After the opening of the side cover, the operator is to grasp the handle 134 of the fixing device 103, and fit the guiding protrusions 133La and 133Rb into the guiding grooves 180La and 180Rb of the rail 180L and 180R, respectively. Then, the operator is to roughly horizontally insert the fixing device 103 into the apparatus main assembly 100, along the guiding grooves 180La and 180R.

Referring to FIG. 7B, as the fixing device 103 is inserted into the apparatus main assembly 100 as described above, the engaging portions 142La1 and 142Ra1 of the arms 142L and 142R of the opening-closing mechanism 140 come into contact with the guiding surfaces 181La and 181Rb of the guides 181L and 183R. As the fixing device 103 is inserted further, the arm 142L and 142R are rotated in the counterclockwise direction, causing thereby the shutter 141 to upwardly rotate. Consequently, the shutter 141 is held by the guiding surfaces 181La and 181Rb in a manner to keep the opening O1 of the fixing device 103 exposed, as shown in FIG. 7C, and the fixing device 103 is moved into the normal position (preset position which allows sheet S to be introduced into fixing device) for the fixing device 101, in the apparatus main assembly 100.

Further, the apparatus main assembly 100 and fixing device 103 are structured so that as the fixing device 103 is moved into its normal position in the apparatus main assembly 100, the electrodes (unshown) with which the apparatus main assembly 100 is provided come into contact with the electrodes (unshown) with which the cover 133L (or 133R) of the fixing device 103, to establish electrical connection between the apparatus main assembly 100 and fixing device 100 so that the heater 131 is supplied with electrical power from the electrodes of the apparatus main assembly 100, through the electrodes of the fixing device 103.

As the shutter 141 is rotationally moved upward, it exposes the opening O1, and covers the handle 134 (FIG. 3) to protect the handle 134 from contaminants and the like.

When it is necessary to take the fixing device 103 out of the apparatus main assembly 100, the operator is to open the side cover (unshown) of the apparatus main assembly 100 to expose the fixing device space 100S in the apparatus main assembly 100. Then, the operator is to grasp the handle 134, and roughly horizontally pull the fixing device 103 out of the apparatus main assembly 100 along the guide grooves 180La and 180Rb (FIG. 7(*c*)).

As the fixing device 103 is moved outward of the apparatus main assembly 100, the engaging portion 142La1 and 142Ra1 of the arms 142L and 142R separate from the guiding surfaces 181La and 181Rb of the guide 181L and 181R, respectively. Then, as the fixing device 103 is moved further outward, the arms 142L and 142R rotate in the counterclockwise direction, causing thereby the shutter 141 to rotationally move downward. Consequently, the opening O1 of the fixing device 103 is covered by the shutter 141 as shown in FIG. 7A.

As described above, the frame of the fixing device 103 (fixation unit) is provided with the openings O1 for allowing the air from the airflow generating member Q to be blown at the rotational fixing member 116, and the shutter 141 which is movable into the first and second positions in which the shutter 141 keeps the opening O1 covered, and exposed, respectively. Further, as the fixation unit is moved out of the apparatus main assembly 100, the shutter 141 is moved from its second position to its first position by the outward movement of the fixation unit. Incidentally, a numeral 300 in FIG. 7C stands for a part of the frame of the fixation unit, which is at the center of the fixation unit (in terms of direction parallel to generatrix of rotational fixing member). Therefore, as the shutter 141 is moved into its second position (exposing position), the rotational fixing member 116 is exposed from the frame of the fixation unit, except for the center portion (which corresponds to center portion 300 of frame) in terms of the direction parallel to the generatrix of the rotational fixing member 116.

Figure 8:
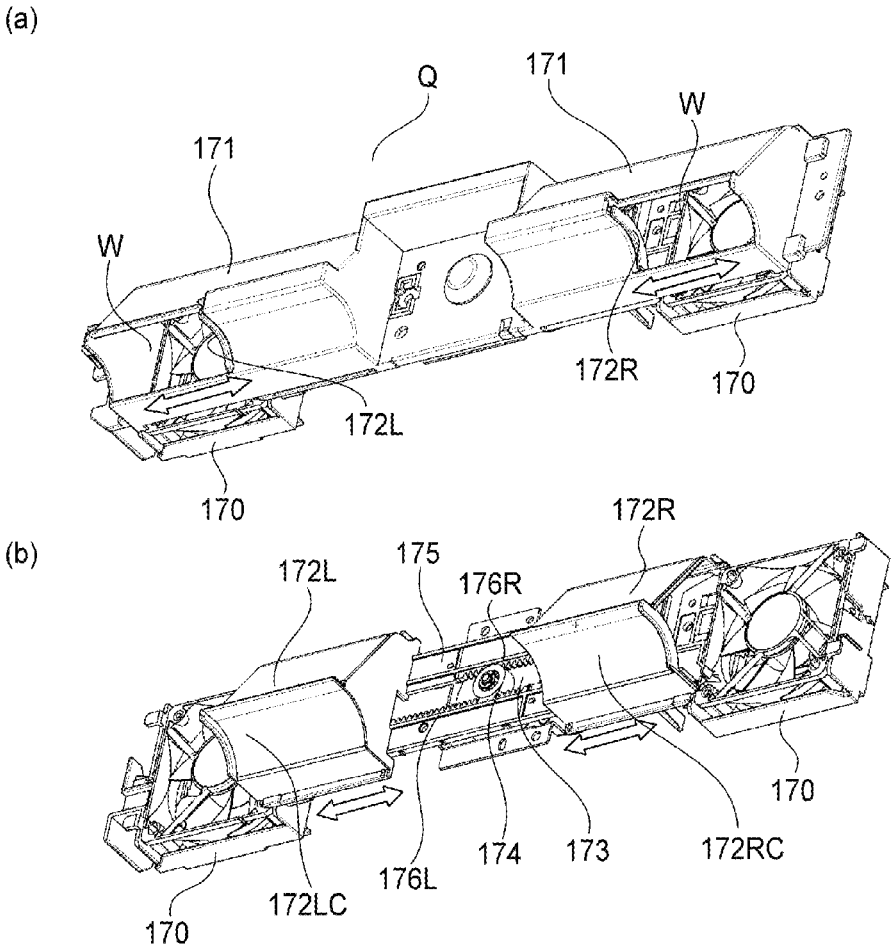
FIG. 8 is a perspective view of the cooling device for cooling the lengthwise end portions of the rotational fixing member to prevent the lengthwise end portions of the rotational member from excessively increasing in temperature, and shows the general structure of the device.

(6) Structure of Cooling Device Q of Apparatus Main Assembly 100 for Preventing Out-of-Sheet-Path Portions of Rotational Fixing Member of Fixing Device from Excessively Increasing in Temperature FIG. 8 is a perspective view of the cooling device Q for preventing the lengthwise end portions of the rotational fixing member (fixation belt 116) from excessively increasing in temperature. It shows the general structure of the device Q. More specifically, FIG. 8(*a*) is a perspective view of the cooling device Q as seen from the side of the air outlet W of the duct 171 for cooling the lengthwise end portions of the fixation belt 116. FIG. 8(*b*) is a perspective view of the duct shutter mechanism located at the air outlet W of the duct 171. It shows the overall structure of the duct shutter mechanism.

Regarding the cooling device Q for preventing the out-of-sheet-path portions of the rotational fixing member of the fixing device from excessively increasing in temperature, air (cooling air) is sent from the cooling fan (airflow generating member) 170 to the duct 171 for cooling the lengthwise end portions of the rotational fixing member 116. Then, the air comes out of the air outlet W (FIG. 3) of the duct 171 to be blown at the portions of the fixation belt 116, which correspond to the out-of-sheet-path portions of the fixation nip N2, that is, the portions of the fixation nip N2, which a small sheet does not pass, to cool the out-of-sheet-path portions of the fixation belt 116. That is, the airflow generating member 170 sends cooling air to the lengthwise end portions of the rotational fixing member 116 in terms of the direction parallel to the generatrix of the rotational fixing member 116.

Referring to FIG. 8(*a*), the cooling device Q for preventing the widthwise end portions of the fixation belt 116 from excessively increasing in temperature is provided with the ducts 171 located in the adjacencies of the widthwise end portions of the fixation belt 116 (unshown) to cool the widthwise end portions of the fixation belt 117, and the cooling fan 170. This cooling device Q is structured so that it blows air at the out-of-sheet-path portions of the fixation belt 116 to cool the out-of-sheet-path portions of the fixation belt 116 to prevent the out-of-sheet-path portions of the fixation belt 116 from excessively increasing in temperature, when a substantial number of small sheets are continuously conveyed through the fixation nip N2.

Referring to FIG. 8(*b*), there are disposed in the cooling duct 171, a pair of duct shutters 172L and 172R, which are supported so that they can be moved in the lengthwise direction of the frame 175, and also, are in connection to a pair of racks 176L and 176R, respectively. The racks 176L and 176R are in engagement with a driving gear 174 with which the output shaft of a pulse motor 173 is provided. Thus, as the pulse motor 173 is driven, the duct shutters 172L and 172R are moved in the lengthwise direction of the frame 175 to open or close the air outlet W. That is, the shutters 172L and 172R can change in dimension, the ranges, in terms of the direction of the generatrix of the fixation belt 116, across which air is blown at the fixation belt 116.

Where the duct shutters 172L and 172R are to be positioned (stopped) is determined based on the size of a sheet of recording medium to be used for an image forming operation. That is, where the duct shutters 172L and 172R are to be moved is controlled by the amount by which the pulse motor 173 is driven. Thus, the air outlets W can be optimized in dimension in terms of the direction of the generatrix of the fixation belt 116 so that the dimension of the air outlet W matches the dimension (width) of the out-of-sheet-path portions of the fixation belt 116.

Further, referring to FIGS. 3 and 8, as the fixing device 103 is installed into its preset position in the apparatus main assembly 100, the duct 171 enters the fixation unit, and semicylindrically curved portions 172LC and 172RC of the shutter 172, which faces the fixation belt 116, are positioned in the adjacencies of the fixation belt 116. That is, the apparatus main assembly 100 and fixation unit are structured so that as the fixation unit is installed into the main assembly of the printer, the tip of the duct is positioned close to the fixation belt 116. Therefore, it is possible to precisely control at which portions of the fixation belt 116 the cooling air will be blown.

As described above, in the case of the fixing device 103 in this embodiment, it is the apparatus main assembly 100 that is provided with the cooling fan 170 and duct 171 for cooling the out-of-sheet-path portions of the fixation belt 116 of the fixing device 103. Therefore, the fixing device 103 in this embodiment is less in manufacturing cost than any fixing device in accordance with the prior art. Further, it is structured so that during its maintenance, its opening O1 is covered by its shutter 141. Therefore, it can protect its fixation belt 116 during its maintenance.

(Miscellanies)

The present invention is also applicable to a fixing device, the rotational fixing member of which is a cylindrical and hollow fixation roller, and the heating member of which is a halogen heater. Further, it is applicable to a fixing device, the rotational fixing member of which is a cylindrical fixation belt having a heat generating layer which can be inductively heated, and the heating member of which is a coil (magnetic flux generating means) which generates magnetic flux to heat the fixation belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 087523/2013 and 063767/2014 filed Apr. 18, 2013 and Mar. 26, 2014, respectively which are hereby incorporated by reference.

What is claimed is:

1. An image forming apparatus comprising:

a main assembly;

a fixing unit including a fixing rotatable member for fixing an unfixed image formed on a recording material, and a frame for accommodating said fixing rotatable member, said fixing unit is detachably mountable to said main assembly; and an air feeding member for feeding air to said fixing rotatable member provided in said main assembly, wherein said frame is provided with an opening for applying the air fed from said air feeding member to said fixing rotatable member, and an openable member movable between a first position for closing said opening and a second position for opening said opening, wherein said openable member moves from the second position to the first position in response to an operation of taking said fixing unit out of said main assembly.

2. An apparatus according to claim 1, wherein said air feeding member applies the air to an end portion of said fixing rotatable member with respect to a generatrix direction of said fixing rotatable member.

3. An apparatus according to claim 2, wherein said main assembly is provided with a shutter capable of changing an air feeding width with respect to the generatrix direction.

4. An apparatus according to claim 2, wherein when said openable member moves to the second position, said fixing rotatable member is exposed the frame.

5. An apparatus according to claim 4, wherein when said openable member moves to the second position, a portion except for a central portion of said fixing rotatable member with respect to the generatrix direction is exposed through said frame.

6. An apparatus according to claim 1, wherein said openable member moves in a direction crossing with the generatrix direction of said fixing rotatable member.

7. An apparatus according to claim 1, wherein said fixing unit is provided with a holding portion for being held by an operator, and said openable member covers said holding portion in the second position.

8. An apparatus according to claim 1, wherein said fixing rotatable member is a film.

9. An apparatus according to claim 8, wherein said fixing unit includes a heater contacting an inner surface of said film.

10. A fixing unit detachably mountable to a main assembly of an image forming apparatus, said fixing unit comprising:

a fixing rotatable member; and a frame accommodating said fixing rotatable member;

wherein said frame is provided with an opening for applying air fed by an air feeding member provided in the main assembly to said fixing rotatable member, and an openable member movable between a first position for closing said opening and a second position for opening said opening, wherein said openable member moves from the second position to the first position in response to an operation of taking said fixing unit out of the main assembly.

11. A fixing unit according to claim 10, wherein when said openable member moves to the second position, said fixing rotatable member is exposed the frame.

12. A fixing unit according to claim 11, wherein when said openable member moves to the second position, a portion except for a central portion of said fixing rotatable member with respect to the generatrix direction is exposed through said frame.

13. A fixing unit according to claim 10, wherein said openable member moves in a direction crossing with the generatrix direction of said fixing rotatable member.

14. A fixing unit according to claim 10, wherein said fixing unit is provided with a holding portion for being held by an operator, and said openable member covers said holding portion in the second position.

15. A fixing unit according to claim 10, wherein said fixing rotatable member is a film.

16. A fixing unit according to claim 15, wherein said fixing unit includes a heater contacting an inner surface of said film.

* * * * *